US009358821B2

(12) United States Patent
Sakano

(10) Patent No.: US 9,358,821 B2
(45) Date of Patent: Jun. 7, 2016

(54) TAPE CARTRIDGE

(71) Applicant: Seiko Epson Corporation, Tokyo (JP)

(72) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/741,331

(22) Filed: Jun. 16, 2015

(65) Prior Publication Data

US 2015/0283838 A1 Oct. 8, 2015

Related U.S. Application Data

(63) Continuation of application No. PCT/JP2015/058322, filed on Mar. 19, 2015.

(30) Foreign Application Priority Data

Mar. 24, 2014 (JP) ..... 2014-060922

(51) Int. Cl.
*B41J 32/00* (2006.01)
*B41J 3/407* (2006.01)
*B41J 15/04* (2006.01)

(52) U.S. Cl.
CPC ..... *B41J 32/00* (2013.01); *B41J 3/4075* (2013.01); *B41J 15/044* (2013.01)

(58) Field of Classification Search
CPC ..... B41J 2/305; B41J 3/38; B41J 3/4075; B41J 15/044
See application file for complete search history.

(56) References Cited

U.S. PATENT DOCUMENTS

| | | | |
|---|---|---|---|
| 8,382,389 | B2 | 2/2013 | Yamaguchi et al. |
| 8,562,228 | B2 | 10/2013 | Yamaguchi et al. |
| 8,651,756 | B2 | 2/2014 | Yamaguchi et al. |
| 8,770,877 | B2 | 7/2014 | Yamaguchi et al. |
| 2010/0166475 | A1 | 7/2010 | Yamaguchi et al. |
| 2010/0166477 | A1 | 7/2010 | Yamaguchi et al. |

(Continued)

FOREIGN PATENT DOCUMENTS

| | | | |
|---|---|---|---|
| JP | 2010-149434 | A | 7/2010 |
| JP | 2010-149437 | A | 7/2010 |

(Continued)

OTHER PUBLICATIONS

International Search Report, Jun. 16, 2015, issued in related Patent Application No. PCT/JP2015/058322.

*Primary Examiner* — Manish S Shah
*Assistant Examiner* — Renee I Wilson
(74) *Attorney, Agent, or Firm* — ALG Intellectual Property, LLC

(57) ABSTRACT

A tape cartridge is detachably installed on a cartridge installation portion of a tape printing apparatus having the cartridge installation portion and a press switch. The cartridge installation portion has an installation base portion and an installation peripheral wall portion surrounding the installation base portion and allows the tape cartridge to be installed on the cartridge installation portion. The press switch has a stem projecting in a direction crossing an installation direction of the tape cartridge and provided on the installation peripheral wall portion. The tape cartridge includes a detected portion that is provided on an outer peripheral surface of the tape cartridge and corresponds to the stem when the tape cartridge is installed on the cartridge installation portion. The detected portion has an installation guide slant surface that presses the stem when the tape cartridge is installed on the cartridge installation portion.

6 Claims, 10 Drawing Sheets

(56) References Cited

U.S. PATENT DOCUMENTS

| | | | |
|---|---|---|---|
| 2010/0166479 | A1 | 7/2010 | Yamaguchi et al. |
| 2011/0103871 | A1 | 5/2011 | Van Coppenlle et al. |
| 2013/0315644 | A1 | 11/2013 | Yamaguchi et al. |
| 2014/0199108 | A1 | 7/2014 | Yamaguchi et al. |
| 2014/0204170 | A1 | 7/2014 | Yamaguchi et al. |
| 2014/0205341 | A1 | 7/2014 | Yamaguchi et al. |
| 2014/0205342 | A1 | 7/2014 | Yamaguchi et al. |
| 2014/0205343 | A1 | 7/2014 | Yamaguchi et al. |
| 2014/0205344 | A1 | 7/2014 | Yamaguchi et al. |
| 2014/0205345 | A1 | 7/2014 | Yamaguchi et al. |
| 2014/0205346 | A1 | 7/2014 | Yamaguchi et al. |
| 2014/0205347 | A1 | 7/2014 | Yamaguchi et al. |
| 2014/0205348 | A1 | 7/2014 | Yamaguchi et al. |
| 2014/0205349 | A1 | 7/2014 | Yamaguchi et al. |
| 2014/0205350 | A1 | 7/2014 | Yamaguchi et al. |
| 2014/0205352 | A1 | 7/2014 | Yamaguchi et al. |
| 2014/0205353 | A1 | 7/2014 | Yamaguchi et al. |
| 2014/0320581 | A1 | 10/2014 | Yamaguchi et al. |
| 2014/0340463 | A1 | 11/2014 | Van Coppenlle et al. |

FOREIGN PATENT DOCUMENTS

| | | | |
|---|---|---|---|
| JP | 2011-520645 | A | 7/2011 |
| JP | 2013-141749 | A | 7/2013 |

| | SWITCH 65A | SWITCH 65B | SWITCH 65C |
|---|---|---|---|
| TAPE CARTRIDGE 100A | ON | OFF | OFF |
| TAPE CARTRIDGE 100B | ON | ON | OFF |
| TAPE CARTRIDGE 100C | ON | ON | ON |
| NON INSTALLED | OFF | OFF | OFF |

TAPE CARTRIDGE

CROSS REFERENCE TO RELATED APPLICATION

This application is a continuation of PCT application No. PCT/JP2015/058322, which was filed on Mar. 19, 2015 based on Japanese Patent Application No. 2014-060922 filed on Mar. 24, 2014, the contents of which are incorporated herein by reference.

BACKGROUND

1. Technical Field

The present invention relates to a tape cartridge detachably installed in a tape printing apparatus in which a press switch is provided on a cartridge installation portion.

2. Background Art

Up until now, a tape cassette having recessed space corresponding to a sensor supporting portion provided on the cassette installation portion of a printing label creation apparatus has been known as such a tape cartridge (see JP-A-2013-141749).

On the cassette installation portion of the printing label creation apparatus, a printing mechanism and a delivering mechanism for performing printing on a tape drawn from the tape cassette are disposed. In addition, on the cassette installation portion, the column-shaped sensor supporting portion incorporating a plurality of sensors for detecting the attribute information of the tape (film tape) is provided to stand. The sensor supporting portion includes four reflection sensors vertically provided on the front side surface thereof and four reflection sensors vertically provided on the right side surface thereof.

On the other hand, the tape cassette includes an adhesive tape spool on which a double-sided adhesive tape is wound, a film tape spool on which the film tape (printing tape) is wound, a ribbon spool on which an ink ribbon is wound, a ribbon winding-up spool that winds up the ink ribbon, a tape driving roller, and a cassette casing that accommodates the above constituents. In addition, in the space between the double-sided adhesive tape and the film tape, the recessed space corresponding to the sensor supporting portion is formed. Further, on a peripheral wall portion constituting the recessed portion, totally eight black detected portions corresponding to the above reflection sensors are provided.

In such a known tape cassette, the detected portions are required to be small in size since the recessed space is provided in the narrow space between the double-sided adhesive tape and the film tape. Therefore, there is a likelihood that an information amount of the attribute information of the film tape to be detected is limited or the detection of the film tape becomes unstable.

On the other hand, if the detected portions are provided on, for example, the lower surface of the tape cassette (tape cartridge) to secure wide space, a force that floats the tape cassette is applied to the tape cassette in a case in which the detection portions on the side of the cassette installation portion are micro switches or the like. Therefore, a structure for suppressing the force is required.

The present invention has an object of providing a tape cartridge that can be prevented from floating from a cartridge installation portion when being installed on the cartridge installation portion.

SUMMARY OF THE INVENTION

According to the present invention, there is provided a tape cartridge is detachably installed on a cartridge installation portion of a tape printing apparatus having the cartridge installation portion and a press switch. The cartridge installation portion has an installation base portion and an installation peripheral wall portion surrounding the installation base portion and allows the tape cartridge to be installed on the cartridge installation portion. The press switch has a stem projecting in a direction crossing an installation direction of the tape cartridge and provided on the installation peripheral wall portion. The tape cartridge includes a detected portion that is provided on an outer peripheral surface of the tape cartridge and corresponds to the stem when the tape cartridge is installed on the cartridge installation portion. The detected portion has an installation guide slant surface that presses the stem when the tape cartridge is installed on the cartridge installation portion.

According to this configuration, the installation guide slant surface presses the stem of the press switch provided on the installation peripheral wall portion when the tape cartridge is installed on the cartridge installation portion. Therefore, the tape cartridge can be prevented from floating from the cartridge installation portion when being installed on the cartridge installation portion.

In this case, the detected portion is preferably recessed on the outer peripheral surface.

According to this configuration, the stem of the press switch can reliably come in contact with the detected portion.

In this case, the installation guide slant surface is preferably slanted in the projecting direction of the stem on a back side in the installation direction.

In this case, the cartridge installation portion preferably allows n types, where n is an integer of two or more, of the tape cartridges having a different thickness in the installation direction to be installed on the cartridge installation portion, the press switch preferably includes n press switches, each of which is different in distance from the installation base portion to a direction opposite to the installation direction, on the installation peripheral wall portion, the detected portion preferably includes n detected portions on the outer peripheral surface of the tape cartridge, and one or more and (n−1) or less of the n detected portions and the detected portions different in number according to the thickness of the tape cartridge preferably further have a removing guide slant surface that releases pressing of the stem when the tape cartridge is installed on the cartridge installation portion and presses the stem when the tape cartridge is removed from the cartridge installation portion.

According to this configuration, the pressing of the stems different in number according to the thickness of the installed tape cartridge is released when the tape cartridge is installed on the cartridge installation portion, the detection of the thickness of the installed tape cartridge is allowed. In addition, the maximum number of the detected portions having the removing guide slant surface is (n−1). Therefore, since the stem is pressed by at least one of the detected portions when the tape cartridge is installed on the cartridge installation portion, the detection of the installation of the tape cartridge on the cartridge installation portion 5 is allowed. Moreover, the detected portion, which releases the pressing of the stem when the tape cartridge is installed on the cartridge installation portion, has the removing guide slant surface that presses the stem at the removal of the tape cartridge from the cartridge installation portion. Therefore, the detected portion is prevented from getting snagged on the stem of the press switch. As a result, the tape cartridge can be smoothly removed from the cartridge installation portion.

In this case, the removing guide slant surface is preferably slanted in the projecting direction of the stem on a near side in the installation direction.

In this case, the n detected portions are preferably dispersedly arranged in a peripheral direction of the outer peripheral surface so as to correspond to the n press switches dispersedly arranged in a peripheral direction of the installation peripheral wall portion.

According to this configuration, the n press switches can be arranged with sufficient space.

In this case, the stem is preferably biased in the projecting direction, and the detected portion, which corresponds to the press switch at a position closest to the printing head provided on the cartridge installation portion, among the n press switches preferably presses the stem of the press switch regardless of the thickness of the installed tape cartridge when the tape cartridge is installed on the cartridge installation portion, and a platen opposing the printing head is preferably further provided.

According to this configuration, the biasing force that biases the stem in the projecting direction can be applied as a force that positions the tape cartridge with respect to the cartridge installation portion near the printing head.

DETAILED DESCRIPTION OF THE EMBODIMENTS

Hereinafter, with reference to the accompanying drawings, a description will be given of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
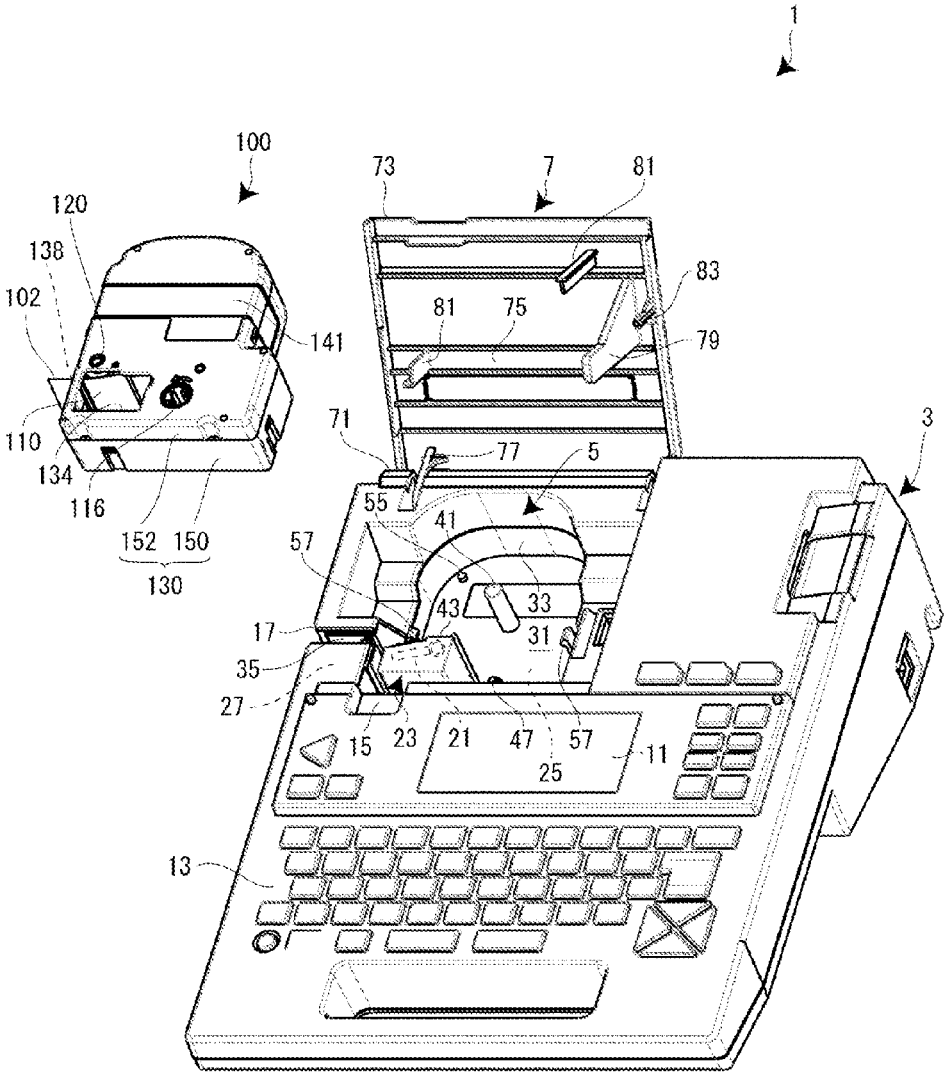
FIG. 1 is an external perspective view of a tape printing apparatus according to an embodiment with its cover opened.

FIG. 1 is an external perspective view of the tape printing apparatus and the tape cartridge installed in the tape printing apparatus. As shown in FIG. 1, a tape printing apparatus 1 includes an apparatus casing 3 constituting an outer shell, a cartridge installation portion 5 on which a tape cartridge 100 is detachably installed, and an opening/closing cover 7 that opens/closes the cartridge installation portion 5. On the upper surface of the apparatus casing 3, the cartridge installation portion 5 is provided on the back side, a display 11 is provided on the central side, and a keyboard 13 is provided on the near side. In the vicinity of the opening/closing cover 7, a finger-hooking recessed portion 15 is provided. The opening/closing cover 7 is opened when the recessed portion 15 is hooked and raised by a finger. Further, on the side surface (left side surface) of the apparatus casing 3, an elongated tape ejection port 17 is provided to eject a printing tape 102.

In addition, the tape printing apparatus 1 includes a printing mechanism portion 23 having a printing head 21 provided to stand on the cartridge installation portion 5, a tape feeding mechanism portion 25 embedded in the back side space of the cartridge installation portion 5, and a tape cutting mechanism portion 27 embedded in the vicinity of the tape election port 17. A user enters printing information via the keyboard 13 and performs printing with a key operation after confirming the printing information on the display 11. Upon the printing instruction, the tape feeding mechanism portion 25 is driven to make the printing tape 102 and the ink ribbon 110 run parallel to each other. Moreover, by heat applied from the printing mechanism portion 23 to the ink ribbon 110, the ink of the ink ribbon 110 is heat-transferred to the printing tape 102 to perform the printing. By the print feeding, the printing tape 102 is ejected from the tape ejection port 17. When the printing is completed, the tape cutting mechanism portion 27 is driven to cut off a printed part of the printing tape 102.

[Outline of Tape Cartridge]

As shown in FIGS. 2A and 2B and FIGS. 5A and 5B, the tape cartridge 100 includes a tape roll 106 in which the printing tape 102 is wound on a tape core 104. In addition, the tape cartridge 100 includes a ribbon roll 114 in which the ink ribbon 110 is wound on a feeding-out core 112 and a winding-up core 116 that winds up the ink ribbon 110 that has been consumed. Moreover, the tape cartridge 100 includes a platen roller 120 (platen) that comes in contact with the printing head 21 and feeds the printing tape 102 and the ink ribbon 110. Further, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Furthermore, the tape cartridge 100 includes an insertion opening 134, in which the printing head 21 is inserted when the tape cartridge 100 is installed in the tape printing apparatus 1, on the cartridge casing 130. The tape cartridge 100 includes a tape delivering port 138 that is provided on the cartridge casing 130 and from which the printing tape 102 is delivered. Note that as will be described in detail later, the tape roll 106 is rotatably supported by a cylindrical core shaft 192 projecting inside the cartridge casing 130.

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the tape delivering port 138 to the tape ejection port 17. On the other hand, the ink ribbon 110 goes around the peripheral wall portion of the insertion opening 134 and is wound up by the winding-up core 116. Note that a plurality of types of tape cartridges (three types of tape cartridges in the embodiment) having a different thickness is available as the tape cartridge 100 according to a tape width of the printing tape 102.

[Details of Tape Printing Apparatus]

Figure 3:
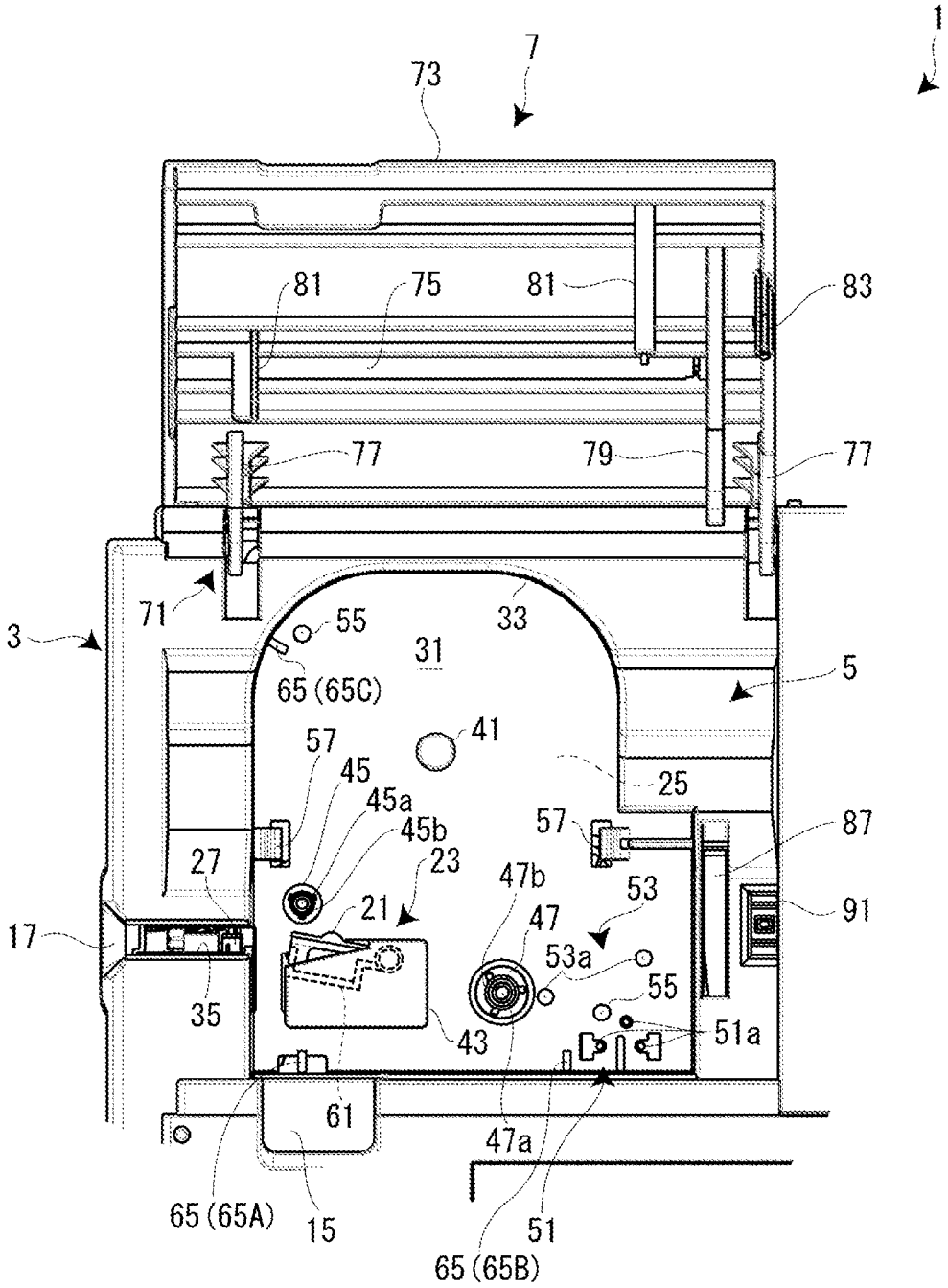
FIG. 3 is a top view of a cartridge installation portion.

As shown in FIG. 1 and FIG. 3, the cartridge installation portion 5 is formed in a shape complementary to the flat shape of the tape cartridge 100 and formed to be recessed with a depth corresponding to the tape cartridge 100 having a maximum thickness among the plurality of types of installable tape cartridges 100. In this case, an installation base portion 31 constituting the bottom plate portion of the cartridge installation portion 5 and an installation peripheral wall portion 33 constituting a side plate portion are integrally formed (molded) by a resin or the like. A slit-shaped tape ejection path 35 is formed between the cartridge installation portion 5 and the tape ejection port 17, and the tape cutting mechanism portion 27 is embedded at this part.

On the installation base portion 31 of the cartridge installation portion 5, a positioning projection 41, in which the core shaft 192 of the tape cartridge 100 fits to be positioned when the tape cartridge 100 is installed, is provided to stand. In addition, on the installation base 31, the printing head 21 covered with a head cover 43, a platen driving shaft 45 that rotates and drives the platen roller 120, and a winding-up driving shaft 47 that rotates and drives the winding-up core 116 are provided to stand. In addition, on the installation base portion 31, a tape detection portion 51 that detects a type (attribute information) of the printing tape 102 and a core releasing portion 53 that releases the rotation-stop of the feeding-out core 112 and the winding-up core 116 are provided in the vicinity of the winding-up driving shaft 47.

Moreover, on the installation base portion 31, a pair of small projections 55 is provided at the diagonal positions, and a pair of retaining pieces 57 that retain the intermediate portion of the installed tape cartridge 100 is provided. Further, in the back side space of the installation base portion 31, the tape feeding mechanism portion 25 constituted of a motor, a gear train (each not shown), or the like that rotates the platen driving shaft 45 and the winding-up driving shaft 47 is embedded. The tape feeding mechanism portion 25 branches power with the gear train and causes the platen driving shaft 45 and the winding-up driving shaft 47 to rotate in synchronization with each other.

The printing mechanism portion 23 includes the printing head 21 constituted of a thermal head and a head supporting frame 61 that supports and rotates the printing head 21. In addition, the printing mechanism portion 23 includes a head releasing mechanism (not shown) that rotates the printing head 21 between a printing position and a retracting position via the head supporting frame 61 and the head cover 43 that covers the printing head 21 (and the head supporting frame 61).

The head releasing mechanism operates as the opening/closing cover 7 is opened/closed and moves (rotates) the printing head 21 to the printing position according to the closing operation of the opening/closing cover 7. In addition, the head releasing mechanism moves (rotates) the printing head 21 to the retracting position according to the opening operation thereof. The printing head 21 comes in contact with the platen roller 120 of the tape cartridge 100 via the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached/detached.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven.

The head cover 43 is formed in a substantially rectangle shape in plan view and integrally formed (molded) with the installation base portion 31 (the cartridge installation portion 5). In addition, the head cover 43 vertically largely projects from the installation base portion 31. The head cover 43 internally allows the rotation of the printing head 21 and externally functions as an installation guide for the tape cartridge 100.

The tape detection portion 51 is constituted of a plurality of micro switches 51*a*, selectively engages with a detection receiving portion 178 of the tape cartridge 100 that will be described later, and detects a type such as a tape color and a material of the printing tape 102. Further, based on the detection result, the driving of the printing head 21 and the tape feeding mechanism portion 25 is controlled. Note that the tape width of the printing tape 102 is detected as the thickness of the tape cartridge 100 by a thickness detection switch 65 that will be described later.

The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a fixation shaft 45*a* inserted in the platen roller 120 and a spline-shaped movable shaft 45*b* rotatably journaled in the base portion of the fixation shaft 45*a*. The rotation power of the tape feeding mechanism portion 25 is transmitted to the movable shaft 45*b* and then transmitted from the movable shaft 45*b* to the platen roller 120. Similarly, the winding-up driving shaft 47 includes a fixation shaft 47*a* and a spline-shaped movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

On the other hand, as shown in FIG. 3, a plurality of thickness detection switches 65 for detecting the thickness of the installed tape cartridge 100 is provided on the installation peripheral wall portion 33 of the cartridge installation portion 5. As the tape cartridge 100 of the embodiment, a thin tape cartridge 100A on which the printing tape 102 having a width of 12 mm is mounted, an intermediate-thickness tape cartridge 100B on which the printing tape 102 having a width of 18 mm is mounted, and a thick tape cartridge 100C on which the printing tape 102 having a width of 24 mm is mounted are, for example, available (see FIGS. 10A and 10B). Note that the width of the printing tape 102 represents the length of the printing tape 102 in a direction crossing a direction in which the printing tape 102 is delivered.

In order to correspond to the three types of tape cartridges 100A, 100B, and 100C having a different thickness, the three thickness detection switches 65 are dispersedly disposed on the installation peripheral wall portion 33 in the peripheral direction. Each of the thickness detection switches 65 is constituted of, for example, a press switch (micro switch). Among the three thickness detection switches 65, a first detection switch 65A is disposed in the vicinity of the printing head 21 (the head cover 43), a second detection switch 65B is disposed in the vicinity of the tape detection portion 51, and a third detection switch 65C is disposed in the vicinity of one of the small projections 55.

As will be described in detail later, the three thickness detection switches 65A, 65B, and 65C are disposed with different distances from the installation base portion 31 so as to correspond to the thicknesses of the three types of tape cartridges 100A, 100B, and 100C. Further, each of the three thickness detection switches 65A, 65B, and 65C is connected to a detection circuit (not shown), and the detection circuit detects the thickness of the installed tape cartridge 100 based on the binary data of detection and non-detection, i.e., the ON/OFF of each of the thickness detection switches 65.

Figure 4:
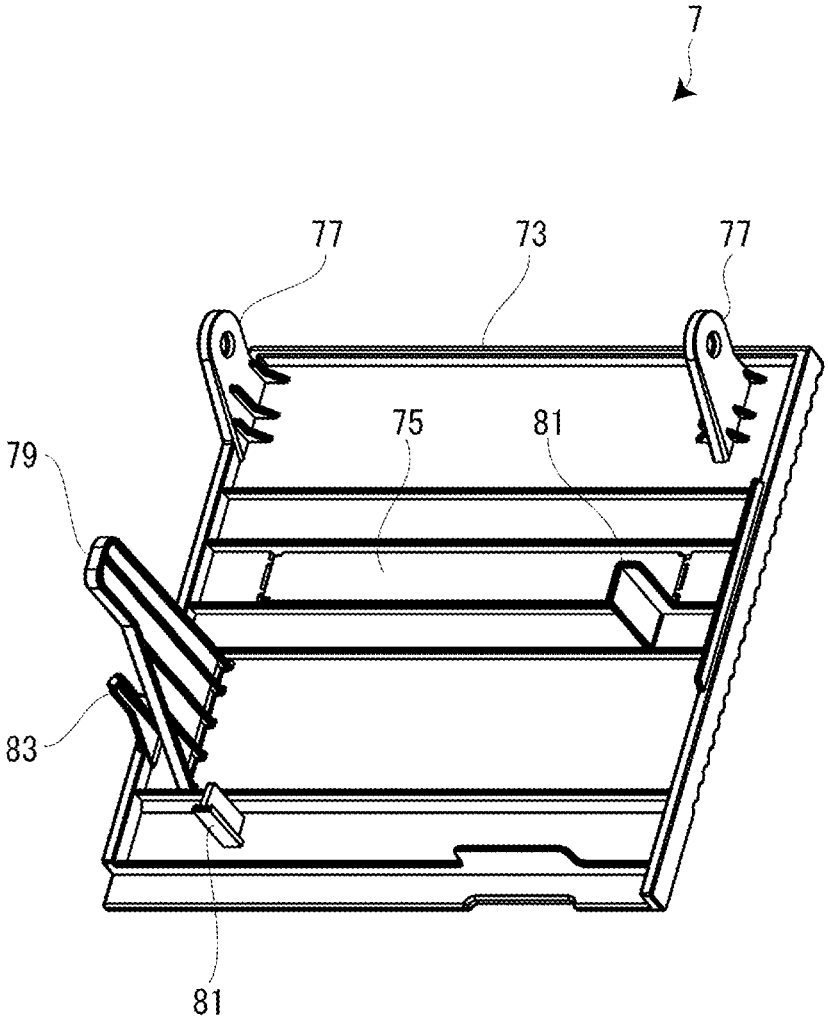
FIG. 4 is a perspective view of the opening/closing cover when seen from the side of its rear surface.

As shown in FIG. 1 and FIG. 4, the opening/closing cover 7 is rotatably, i.e., openably/closably attached to the apparatus casing 3 via a hinge portion 71 provided on the back side. The opening/closing cover 7 includes an opening/closing cover main body 73 and a check window 75 provided at the center of the opening/closing cover main body 73. In addition, the opening/closing cover 7 includes a pair of journaled pieces 77 that projects from the rear surface of the opening/closing cover main body 73 and is rotatably journaled in the hinge portion 71 and an operation lever 79 that projects from the rear surface of the opening/closing cover main body 73 and rotates the printing head 21. Moreover, the opening/closing cover 7 includes two pressing projections 81 that project from the rear surface of the opening/closing cover main body 73 and press the tape cartridge 100 and a pressing projection 83 that projects from the rear surface of the opening/closing cover main body 73 and operates (turns ON) an embedded cover closing detection switch (not shown).

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of journaled pieces 77, the operation lever 79, the two pressing projections 81, and the pressing projection 83 are integrally formed (molded) with the opening/closing cover main body 73 by a resin.

The operation lever 79 projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate toward the platen roller 120. Similarly, as the opening/closing cover 7 is closed, the pressing projection 83 is inserted in a rectangle opening 91 adjacent to the slit opening 87 and causes the cover closing detection switch to operate.

One of the pressing projections 81 is positioned so as to be in the vicinity of the platen roller 120 of the tape cartridge 100. The other of the pressing projections 81 is positioned so as to be right above the tape detection portion 51. When the opening/closing cover 7 is closed, the two pressing projections 81 press the tape cartridge 100 so as to be set on the installation base portion 31 of the cartridge installation portion 5 and prevent the tape cartridge 100 from floating.

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, taking FIGS. 2A and 2B as an example, a surface on the near side in the installation direction, i.e., on the upper front side of the tape cartridge 100 will be called a "front surface," a surface on the back side in the installation direction, i.e., on the opposite side of the tape cartridge 100 will be called a "rear surface," a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface."

As described above, the tape cartridge 100 includes the cartridge casing 130 and the tape roll 106, the ribbon roll 114, the winding-up core 116, and the platen roller 120 accommodated in the cartridge casing 130. In addition, the tape cartridge 100 includes the insertion opening 134 provided on the cartridge casing 130, the tape delivering port 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, a tape width, a tape color, a material, and the like of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a resin molded item transparent to an extent that the visual checking of the accommodated printing tape 102 is allowed, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall portion 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall portion 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 2A:
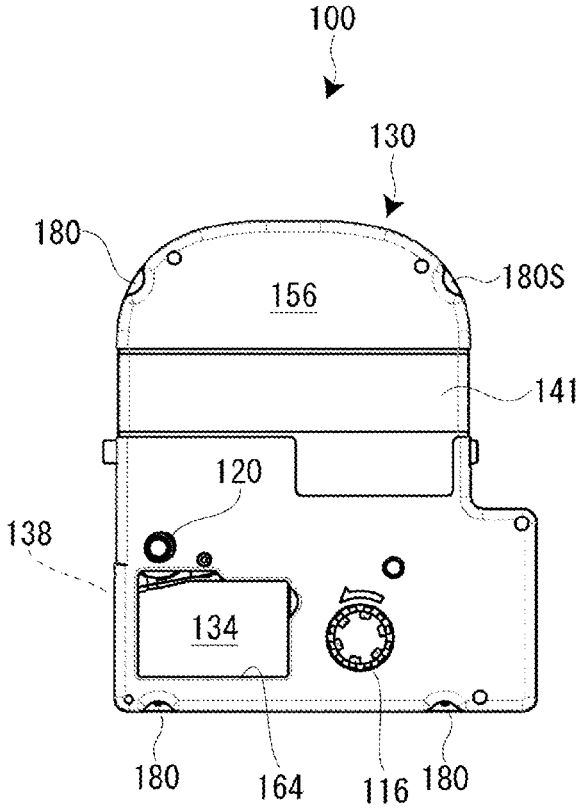
FIGS. 2A and 2B are, respectively, a plan view and a side surface view of a tape cartridge according to the embodiment.
Figure 2B:
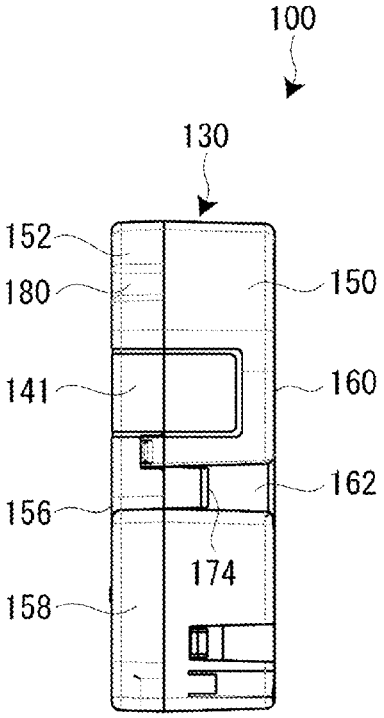
Figure 6:
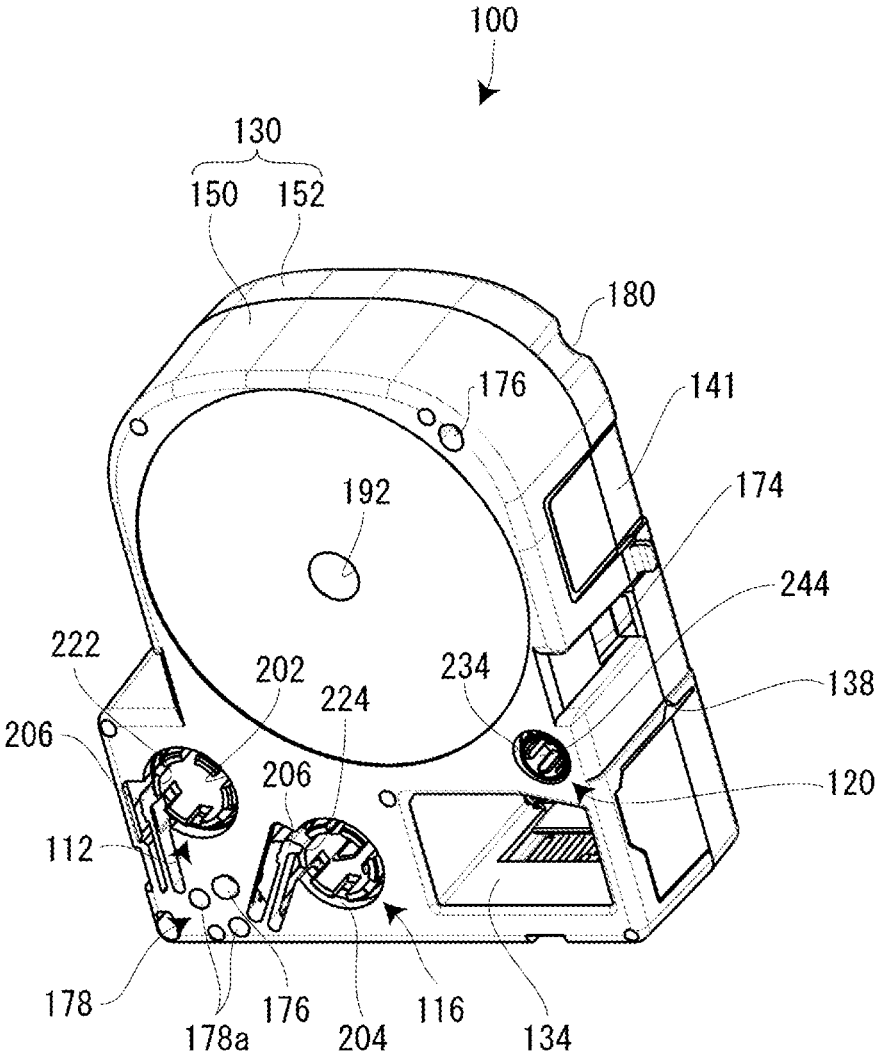
FIG. 6 is a perspective view of the tape cartridge when seen from the side of its rear surface.
Figure 7A:
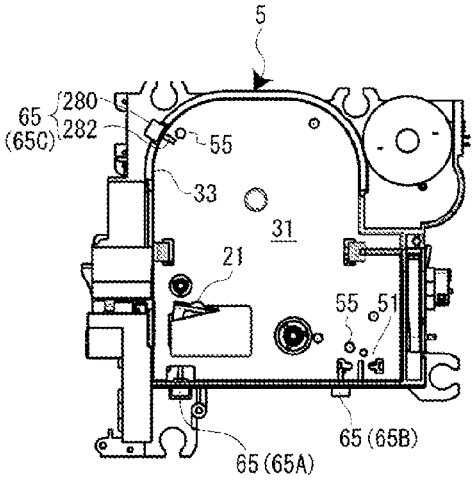
FIGS. 7A to 7C are, respectively, a plan view of the cartridge installation portion, a perspective view of the cartridge installation portion, and a plan view of the cartridge installation portion on which the tape cartridge is installed.
Figure 7C:
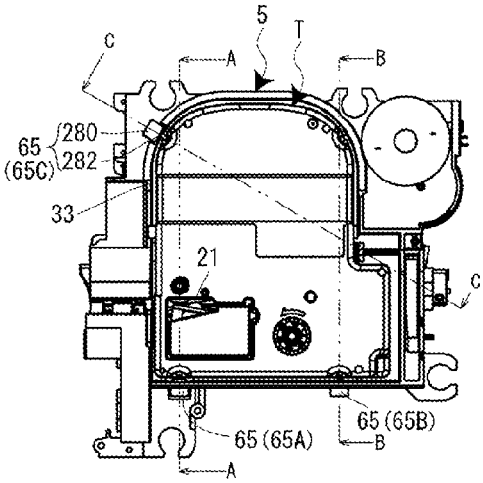
Figure 7B:
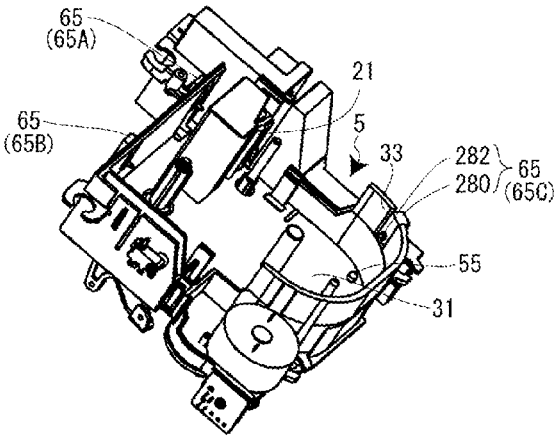
Figure 8A:
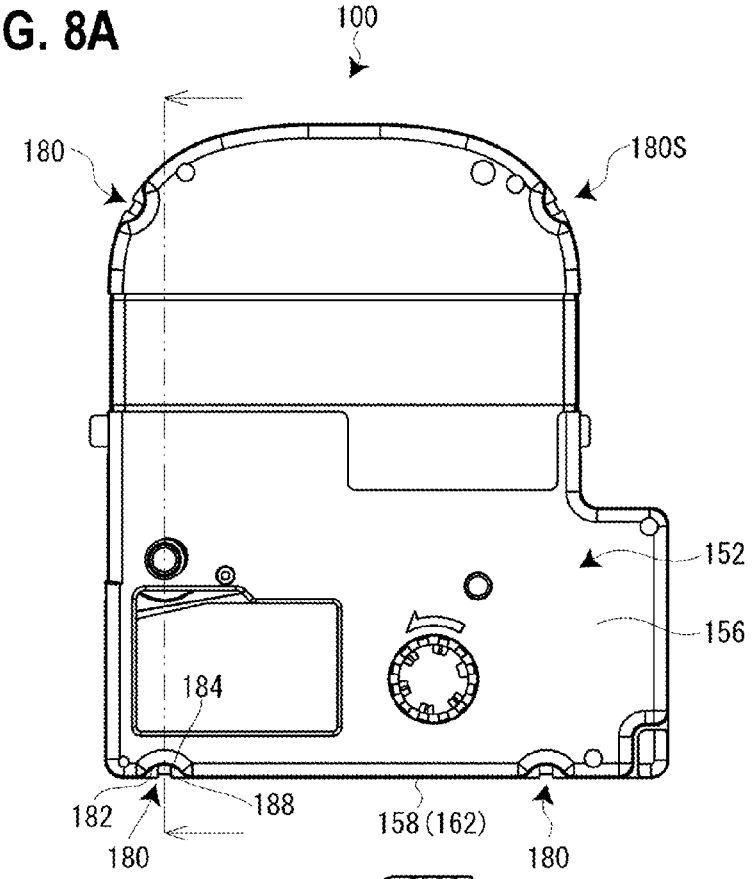
FIGS. 8A and 8B are, respectively, a plan view and a cross-sectional view of the tape cartridge.
Figure 8B:
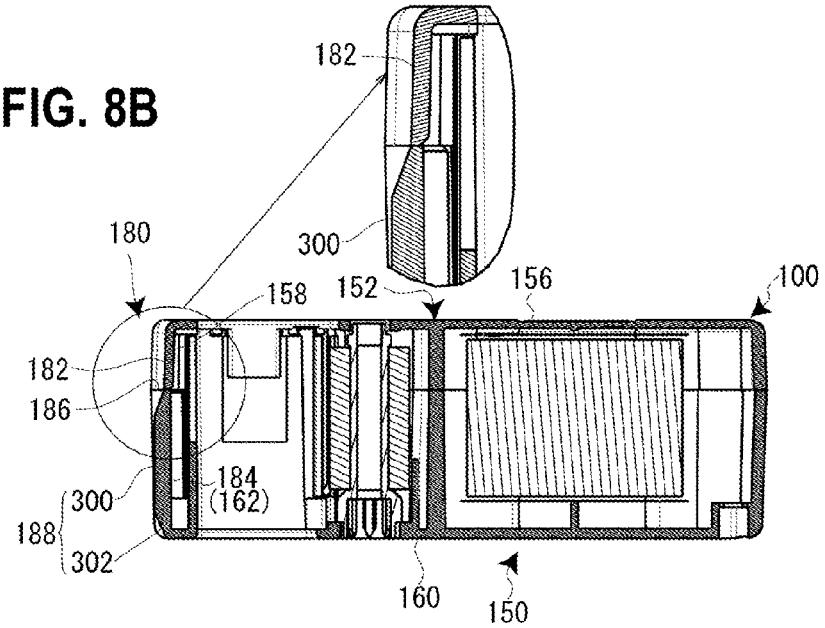
Figure 9A:
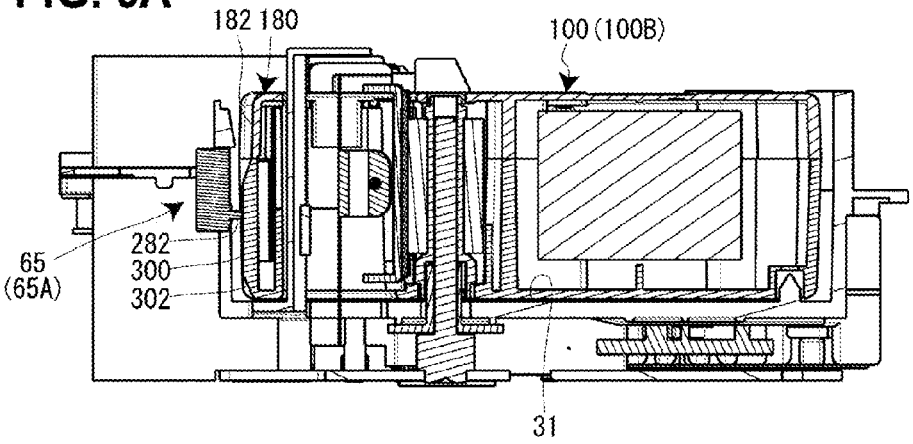
FIGS. 9A to 9C are, respectively, a cross-sectional view taken along the line A-A in FIG. 7C, a cross-sectional view taken along the line B-B in FIG. 7C, and a cross-sectional view taken along the line C-C in FIG. 7C.
Figure 9B:
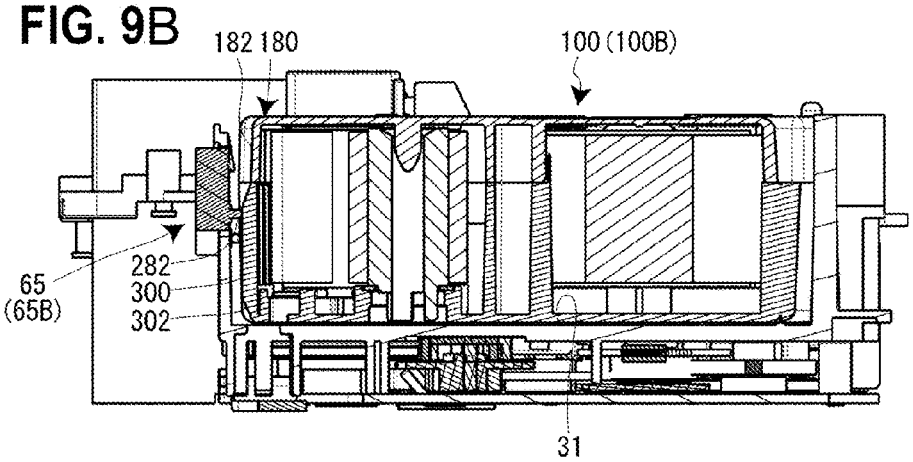
Figure 9C:
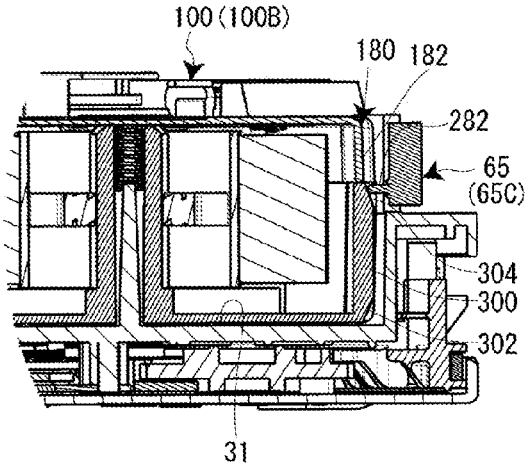

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base portion 31.

Moreover, on the rear surface of the lower casing 150, the detection receiving portion 178 corresponding to the tape detection portion 51 is provided at a left corner part on the side of the base end surface (i.e., at a right corner part as seen from the side of the front surface) (see FIG. 6). The detection receiving portion 178 is constituted at a portion corresponding to the plurality of micro switches 51*a* of the tape detection portion 51, and a plurality of bit patterns is obtained based on the presence or absence of reception holes 180*a* provided at the portion. That is, the bit patterns correspond to a type except for a tape width of the printing tape 102.

On the other hand, as shown in FIGS. 2A and 2B, FIG. 5, and FIGS. 8A and 8B, recessed portions 182 are formed at four places in the peripheral direction of the upper peripheral wall portion 158 of the upper casing 152. In addition, in order to correspond to the recessed portions 182 at the four places, thick wall portions 184 are formed at four places in the peripheral direction of the lower peripheral wall portion 162 of the lower casing 150. Further, the end surface on the side of the upper peripheral wall portion 158 of each of the thick wall portions 184 constitutes a butted surface 186 against which a part of a disassembling jig (not shown) that will be described later is butted.

Although not particularly shown in the figures, the disassembling jig includes, in order to disassemble the used tape cartridge 100, four columns that receive the inverted tape cartridge 100 with the butted surfaces 186 at the four places described above and four extraction pins inserted in the four joining holes 172 of the lower casing 150, the four joining holes 172 being constituted of through holes. In a state in which the tape cartridge 100 is set on the four columns, the four extraction pins are moved downward and inserted in the four joining holes 172 from the rear side of the lower casing 150. Thus, the four extraction pins disassemble the lower casing 150 from the upper casing 152 so as to simultaneously push out (extract) the four joining pins 170 of the upper casing 152.

As described above, the recessed portions 182 at the four places of the upper casing 152 and the thick wall portions 184 at the four places and the butted surfaces 186 at the four places of the lower casing 150 are formed on the cartridge casing 130 as the essential disassembling portions of the tape cartridge 100. In addition, together with sliding portions 188 formed on the outside of the thick wall portions 184, the recessed portions 182, the thick wall portions 184, and the butted surfaces 186 constitute detected portions 180 of the tape cartridge 100 corresponding to the thickness detection switches 65. Note that in the embodiment, three of the four detected portions 180 correspond to the three thickness detection switches 65 (that will be described in detail later).

As shown in FIG. 5, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface of the core shaft 192. In addition, in the tape accommodation area 190, a tape guide 194 that guides the fed-out printing tape 102 to the platen roller 120 is integrally formed with the lower casing 150 so as to stand in the vicinity of the platen roller 120.

That is, inside the cartridge casing 130, a tape feeding path 196 ranging from the tape roll 106 as a starting point to the tape delivering port 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape 102 is further guided from the platen roller 120 to the tape delivering port 138.

The tape roll 106 includes two circular films 198 affixed to both end surfaces of the roll-shaped printing tape 102, besides the printing tape 102 and the tape core 104. The two circular films 198 prevent the printing tape 102 wound on the tape core 104 from spreading out. In addition, although not shown in the figures, a reverse-rotation stop mechanism is embedded in the tape core 104. When the tape cartridge 100 is carried, the reverse rotation of the printing tape 102 is prevented by the reverse-rotation stop mechanism. On the other hand, when the tape cartridge 100 is installed on the cartridge installation portion 5 of the tape printing apparatus 1, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing by the platen roller 120. Moreover, the ink ribbon 110 goes around the opening peripheral wall portion 164 (the plurality of second ribbon guides 212) via the platen roller 120 and is wound up by the winding-up core 116.

Figure 5A:
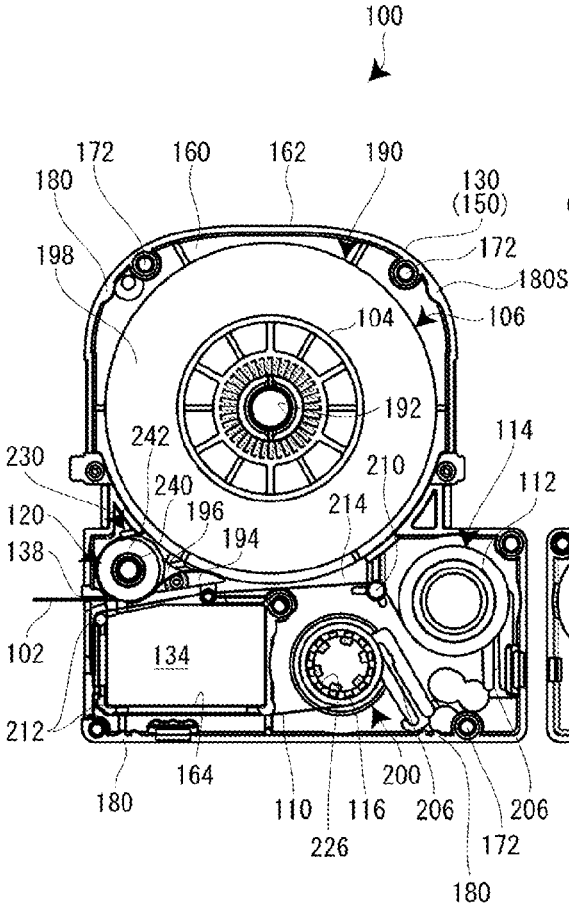
FIGS. 5A and 5B are, respectively, a plan view of the tape cartridge with its upper casing removed and a rear surface view of the upper casing.
Figure 5B:
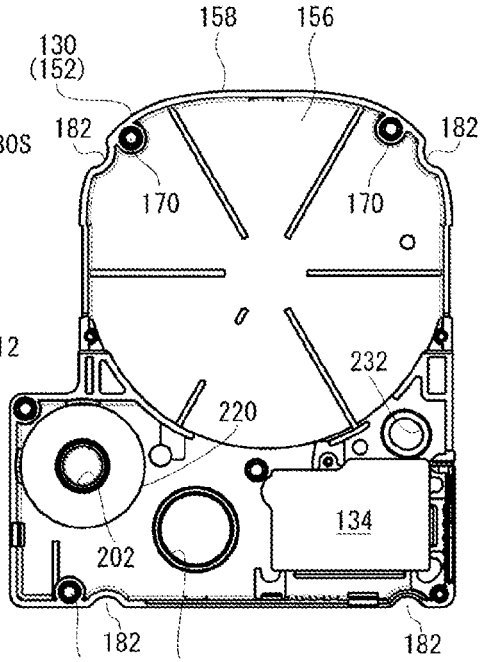

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of the constituents).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical opening formed on the lower casing 150 and an upper bearing portion 232 (see FIG. 5B) having an elliptical (oval) opening formed on the upper casing 152 are provided. Further, by the upper bearing portion 232 and the lower bearing portion 234, the platen roller 120 is supported so as to be rotatable and slightly horizontally movable. That is, the platen roller 120 supported by the elliptical upper bearing portion 232 and the lower bearing portion 234 is configured to be horizontally movable (slightly movable) between a home position at which the platen roller 120 engages with the platen driving shaft 45 and a holding position at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the tape delivering port 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the tape delivering port 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the platen driving shaft 45. Thus, the rotation force of the platen driving shaft 45 is transmitted to the platen roller 120 to print-feed the printing tape 102 (and the ink ribbon 110).

[Details of Detected Portions and Thickness Detection Switches]

Next, with reference to FIG. 3 and FIGS. 7A to 7C to FIGS. 9A to 9C, a description will be given in detail of the structure of the detected portions 180 of the tape cartridge 100 according to the embodiment in conjunction with the structure of the thickness detection switches 65 provided on the cartridge installation portion 5. As described above, the three thickness detection switches 65 are disposed on the installation peripheral wall portion 33 of the cartridge installation portion 5. In order to correspond to the three thickness detection switches 65, the detected portions 180 are formed at the three places of the outer peripheral surface of the tape cartridge 100 and an extra detected portion 180S is formed at one place thereof.

As shown in FIG. 3, FIGS. 7A to 7C, and FIGS. 9A to 9C, the three thickness detection switches 65 are dispersedly disposed in the peripheral direction on the installation peripheral wall portion 33 of the cartridge installation portion 5. As described above, the first detection switch 65A is disposed in the vicinity of the printing head 21, the second detection switch 65B is disposed in the vicinity of the tape detection portion 51, and the third detection switch 65C is disposed in the vicinity of one of the small projections 55.

Each of the thickness detection switches 65 is constituted of, for example, a press switch. Each of the thickness detection switches 65 includes a switch main body 280 attached to the installation peripheral wall portion 33 and a stem 282 that is supported by the switch main body 280 so as to be freely movable back and forth and comes in contact with the tape cartridge 100 (the cartridge casing 130) to operate (turn ON/OFF) the switch main body 280 (see FIGS. 9A to 9C). The stem 282 moves back and forth between a projecting position at which the stem 282 projects from the switch main body 280 in a direction crossing the installation direction, i.e., in a substantially horizontal direction and a pressing position at which the stem 282 is pressed by the tape cartridge 100 installed on the cartridge installation portion 5. In addition, the stem 282 is biased by an internal spring (not shown) in a direction away from the switch main body 280, i.e., in its projecting direction. Further, in the use of the thickness detection switch 65, the thickness detection switch 65 (the switch main body 280) is turned "OFF" when the stem 282 projects from the projecting position due to the spring force of the internal spring and is turned "ON" when the stem 282 is pressed to the pressing position while resisting the internal spring.

That is, when being positioned at the recessed portion 182 or a removing guide slant surface 304 of the sliding portion 188 of the cartridge casing 130, the stem 282 projects from the projecting position, whereby the thickness detection switch 65 is turned OFF. On the other hand, when coming in contact with a contact surface 300 of the sliding portion 188 of the cartridge casing 130, the stem 282 is pressed to the pressing position, whereby the thickness detection switch 65 is turned ON.

In addition, when the stem 282 relatively moves from the contact surface 300 to the removing guide slant surface 304 of the sliding portion 188 at the installation of the tape cartridge 100 on the cartridge installation portion 5, the switch main body (the thickness detection switch 65) changes from its ON state to its OFF state. Similarly, when the stem 282 relatively moves from the removing guide slant surface 304 to the contact surface 300 at the removal of the tape cartridge 100 from the cartridge installation portion 5, the switch main body 280 (the thickness detection switch 65) changes from its OFF state to its ON state.

The first detection switch 65A is disposed such that the stem 282 is pressed while facing the contact surface 300 of the tape cartridge 100 even when the tape cartridge 100 having a different thickness is installed. In other words, the first detection switch 65A is disposed such that the stem 282 is pressed to the pressing position while facing the contact surface 300 to operate (turn ON) the switch main body 280. Specifically, the first detection switch 65A is disposed at a position away from the installation base portion 31 by a distance Da in an upward direction opposite to the installation direction, i.e., at a low position of the cartridge installation portion 5 (see FIGS. 10A and 10B).

Similarly, the second detection switch 65B is disposed such that the stem 282 turns OFF the switch main body 280 while facing the removing guide slant surface 304 of the tape cartridge 100A when the thin tape cartridge 100A is installed. In addition, the second detection switch 65B is disposed such that the stem 282 turns ON the switch main body 280 while facing the contact surface 300 of the tape cartridge 100B when the intermediate-thickness tape cartridge 100B is installed. Moreover, the second detection switch 65B is disposed such that the stem 282 turns ON the switch main body 280 while facing the contact surface 300 of the tape cartridge 100C when the thick tape cartridge 100C is installed. Specifically, the second detection switch 65B is disposed at a position away from the installation base portion 31 by a distance Db (>Da) in the upward direction, i.e., at an intermediate position of the cartridge installation portion 5 (see FIGS. 10A and 10B).

Similarly, the third detection switch 65C is disposed such that the stem 282 turns OFF the switch main body 280 while facing the recessed portion of the tape cartridge 100A when the thin tape cartridge 100A is installed. In addition, the third detection switch 65C is disposed such that the stem 282 turns OFF the switch main body 280 while facing the removing guide slant surface 304 of the tape cartridge 100B when the intermediate-thickness tape cartridge 100B is installed. Moreover, the third detection switch 65C is disposed such that the stem 282 turns ON the switch main body 280 while facing the contact surface 300 of the tape cartridge 100C when the thick tape cartridge 100C is installed. Specifically, the third detection switch 650 is disposed at a position away from the installation base portion 31 by a distance Dc (>Db) in the upward direction, i.e., at a high position of the cartridge installation portion 5 (see FIGS. 10A and 10B).

As will be described in detail later, the first detection switch 65A is turned ON, the second detection switch 65B is turned ON, and the third detection switch 65C is turned OFF when the intermediate-thickness tape cartridge 100B is, for example, installed on the cartridge installation portion 5. The above detection circuit connected to the three thickness detection switches 65 detects a thickness type of the installed tape cartridge 100 based on whether the first detection switch 65A, the second detection switch 65B, and the third detection switch 65C are turned ON/OFF (see FIGS. 10A and 10B).

On the other hand, as shown in FIGS. 8A and 8B and FIGS. 9A to 90, the tape cartridge 100 is provided with the detected portions 180 at the three places of the outer peripheral surface thereof so as to correspond to the three thickness detection switches 65. As described above, each of the detected portions 180 includes the recessed portion 182 recessed on the upper peripheral wall portion 158 of the upper casing 152, the thick wall portion 184 formed at the lower peripheral wall portion 162 of the lower casing 150 so as to correspond to the recessed portion 182, the butted surface 186, i.e., the end surface on the side of the upper peripheral wall portion 158 of the thick wall portion 184, and the sliding portion 188 recessed on the outer surface of the thick wall portion 184.

The recessed portion 182 is a groove-shaped portion at which the opposing thickness detection switch 65 is turned OFF, and is recessed to be formed in an arc shape in cross section toward the inside thereof. In addition, the recessed portion 182 is formed to extend from the upper end to the lower end of the upper peripheral wall portion 158 including the top wall portion 156 over the thickness of the upper casing 152. The stem 282 of the thickness detection switch 65 facing the recessed portion 182 projects from the switch main body 280 to the projecting position, whereby the thickness detection switch 65 is turned OFF.

The thick wall portion 184 is formed in an arc shape in cross section so as to follow the recessed portion 182. In this case, however, the thick wall portion 184 is formed in the arc shape in cross section slightly larger than the recessed portion 182 by the thickness of the upper peripheral wall portion 158. In addition, the butted surface 186 corresponding to the end surface on the side of the recessed portion 182 (on the side of the upper peripheral wall portion 158) of the thick wall portion 184 is formed in the same shape as the cross section of the thick wall portion 184.

The sliding portion 188 is formed to extend from the upper end to the lower end of the lower peripheral wall portion 162 over the thickness of the lower casing 150. The sliding portion 188 includes an installation guide slant surface 302 provided at the lower end thereof and the contact surface 300 communicating with the upper side of the installation guide slant surface 302. Moreover, a part of the sliding portion 188 includes the removing guide slant surface 304 communicating with the upper side of the contact surface 300.

The contact surface 300 is formed to be substantially parallel to the installation direction. The installation guide slant surface 302 is slanted in the projecting direction of the stem 282 on the back side thereof, i.e., on the lower side thereof in the installation direction. The installation guide slant surface 302 presses the stem 282 to the pressing position when the tape cartridge 100 is installed on the cartridge installation portion 5. On the other hand, the removing guide slant surface 304 is slanted in the projecting direction of the stem 282 on the near side thereof, i.e., on the upper side thereof in the installation direction. The installation guide slant surface 302 releases the pressing of the stem 282 when the tape cartridge 100 is installed on the cartridge installation portion 5, and presses the stem 282 to the pressing position when the tape cartridge 100 is removed from the cartridge installation portion 5.

More specifically, as for the thin tape cartridge 100A, two of the three detected portions 180 corresponding to the second detection switch 65B and the third detection switch 65C have the installation guide slant surface 302. In addition, as for the intermediate-thickness tape cartridge 100B, one of the three detected portions 180 corresponding to the third detection switch 65C has the installation guide slant surface 302 (see FIGS. 9A to 9C). On the other hand, as for the thick tape cartridge 100C, any of the three detected portions 180 does not have the installation guide slant surface 302.

Note that although the detected portion 180 of the thin tape cartridge 100A corresponding to the first detection switch 65A is formed to have the same slant surface as the installation guide slant surface 302, it may not have the slant surface. That is, the upper end corner of the detected portion 180 may be formed in a substantially square shape in cross section. Same applies to the detected portions 180 corresponding to the first detection switch 65A and the second detection switch 65B of the intermediate-thickness tape cartridge 100B and the three detected portions 180 of the thick tape cartridge 100C.

Meanwhile, a difference in the thickness between the plurality of types of tape cartridges 100 is adjusted by a difference in the thickness of the lower casing 150. That is, in the installed tape cartridge 100, the height position of the removing guide slant surface 304, which is formed at the upper end of the lower casing 150, from the installation base portion 31 becomes a fixed position at which the thickness of the tape cartridge 100 is indicated.

Accordingly, when the thin tape cartridge 100A ("the cartridge having a width of 12 mm") is installed on the cartridge installation portion 5, the first detection switch 65A is turned ON and the second detection switch 65B and the third detection switch 65C are turned OFF.

In addition, when the intermediate-thickness tape cartridge 100B ("the cartridge having a width of 18 mm") is installed, the first detection switch 65A and the second detection switch 65B are turned ON and the third detection switch 65C is turned OFF.

Moreover, when the thick tape cartridge 100C ("the cartridge having a width of 24 mm") is installed, any of the first detection switch 65A, the second detection switch 65B, and the third detection switch 65C is turned ON.

[Detection of Thickness of Tape Cartridge]

Figures 10A, 10B:
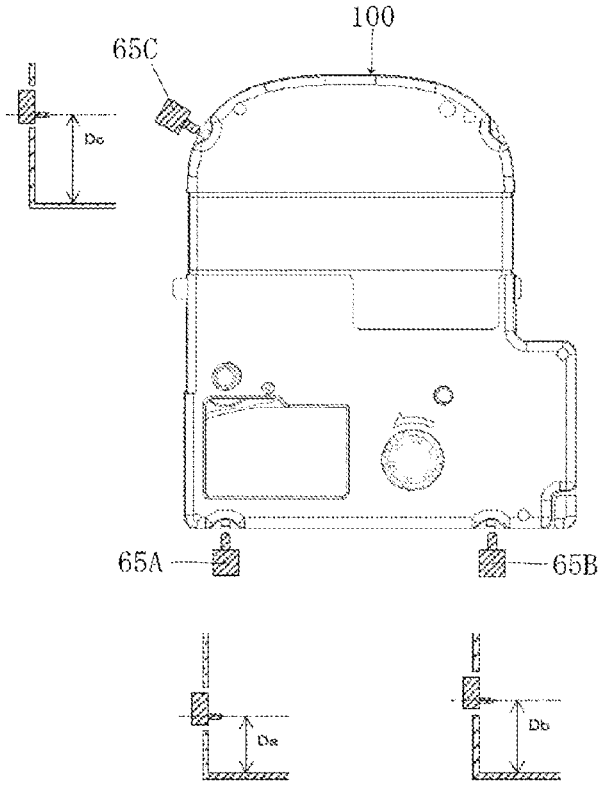
FIGS. 10A and 10B are explanatory views showing a method for detecting the thickness of the tape cartridge with a plurality of thickness detection switches.

FIGS. 10A and 10B show a method for detecting the thickness (type) of the tape cartridge 100. As shown in the figures, the three thickness detection switches 65A, 65B, and 65C are provided such that the distances from the installation base portion 31 in the direction opposite to the installation direction, i.e., in the upward direction are different.

Further, the detection circuit determines that the thin tape cartridge 100A is installed when the first detection switch 65A is turned ON and the second detection switch 65B and the third detection switch 65C are turned OFF.

Similarly, the detection circuit determines that the intermediate-thickness tape cartridge 100B is installed when the first detection switch 65A and the second detection switch 65B are turned ON and the third detection switch 65C is turned OFF.

Similarly, the detection circuit determines that the thick tape cartridge 100C is installed when all of the first detection switch 65A, the second detection switch 65B, and the third detection switch 65 are turned ON.

As described above, when the tape cartridge 100 of the embodiment is installed on the cartridge installation portion 5, the installation guide slant surface 302 presses the stem 282 of the thickness detection switch 65 provided on the installation peripheral wall portion 33. Therefore, when being installed on the cartridge installation portion 5, the tape cartridge 100 can be prevented from floating from the cartridge installation portion 5. In addition, since the detected portion 180 has the installation guide slant surface 302, it is prevented from getting snagged on the stem 282 of the thickness detection switch 65. As a result, the tape cartridge 100 can be smoothly installed on the cartridge installation portion 5.

In addition, since the pressing of the stems 282 different in number according to the thickness of the installed tape cartridge 100 is released when the tape cartridge 100 is installed on the cartridge installation portion 5, the detection of the thickness of the installed tape cartridge 100 is allowed. In addition, the maximum number of the detected portions 180 having the removing guide slant surface 304 is two. Therefore, since the stem 282 is pressed to the pressing position by at least one of the detected portions 180, i.e., the detected portion 180 corresponding to the first detection switch 65A when the tape cartridge 100 is installed on the cartridge installation portion 5, the detection of the installation of the tape cartridge 100 on the cartridge installation portion 5 is allowed. Moreover, the detected portion 180, which releases the pressing of the stem 282 when the tape cartridge 100 is installed on the cartridge installation portion 5, has the removing guide slant surface 304 that presses the stem 282 to the pressing position at the removal of the tape cartridge 100 from the cartridge installation portion 5. Thus, the detected portion 180 is prevented from getting snagged on the stem 282 of the thickness detection switch 65. As a result, the tape cartridge 100 can be smoothly removed from the cartridge installation portion 5

In addition, the three detected portions 180 corresponding to the three thickness detection switches 65 are provided on the outer peripheral surface of the cartridge casing 130. Therefore, the upsizing of the tape cartridge 100 due to the detected portions 180 can be prevented. Moreover, the thickness of the tape cartridge 100 is detected using the thickness of the lower casing 150. Therefore, the complication of the structure of the tape cartridge 100 due to the detected portions 180 can be prevented, and thus the thickness of the tape cartridge 100 can be reliably detected. Besides, the detected portions 180 can also serve as essential disassembling portions for disassembling the tape cartridge 100.

Further, the spring forces of the thickness detection switches 65 are laterally applied to the tape cartridge 100. Therefore, the positional deviation of the tape cartridge 100 can be prevented by the three dispersedly-arranged thickness detection switches 65. In particular, the first detection switch 65A, the second detection switch 65B, and the third detection switch 65C are disposed so as to be distant in this order from the platen roller 120 that receives a pressing force from the printing head 21, and the three thickness detection switches 65 are arranged so as to resist the pressing force of the printing head 21 to a greater extent.

Note that in the embodiment, the three types of tape cartridges 100 having a different thickness are detected. However, it may be possible to increase the number of the thickness detection switches 65 and the detected portions 180 to detect three or more types of the tape cartridges 100. Conversely, the tape cartridge 100 may include only one of the detected portions 180, and the press switch functioning as the thickness detection switch 65 in the embodiment may function as an installation detection switch for detecting the installation/non-installation of the tape cartridge 100.

What is claimed is:

1. A tape cartridge detachably installed on a cartridge installation portion of a tape printing apparatus having the cartridge installation portion and a press switch, the cartridge installation portion having an installation base portion and an installation peripheral wall portion surrounding the installation base portion and allowing the tape cartridge to be installed on the cartridge installation portion, the press switch having a stem projecting in a direction crossing an installation direction of the tape cartridge and provided on the installation peripheral wall portion, the tape cartridge comprising:

a detected portion that is provided on an outer peripheral surface of the tape cartridge and corresponds to the stem when the tape cartridge is installed on the cartridge installation portion, wherein the detected portion has an installation guide slant surface that presses the stem when the tape cartridge is installed on the cartridge installation portion, the cartridge installation portion allows n types, where n is an integer of two or more, of the tape cartridges having a different thickness in the installation direction to be installed on the cartridge installation portion, the press switch includes n press switches, each of which is different in distance from the installation base portion to a direction opposite to the installation direction, on the installation peripheral wall portion, the detected portion includes n detected portions on the outer peripheral surface of the tape cartridge, and one or more and (n−1) or less of the n detected portions and the detected portions different in number according to the thickness of the tape cartridge further have a removing guide slant surface that releases pressing of the stem when the tape cartridge is installed on the cartridge installation portion and presses the stem when the tape cartridge is removed from the cartridge installation portion.

2. The tape cartridge according to claim 1, wherein the detected portion is recessed on the outer peripheral surface.

3. The tape cartridge according to claim 1, wherein the installation guide slant surface is slanted in the projecting direction of the stem on a back side in the installation direction.

4. The tape cartridge according to claim 1, wherein the removing guide slant surface is slanted in the projecting direction of the stem on a near side in the installation direction.

5. The tape cartridge according to claim 1, wherein the n detected portions are dispersedly arranged in a peripheral direction of the outer peripheral surface so as to correspond to the n press switches dispersedly arranged in a peripheral direction of the installation peripheral wall portion.

6. The tape cartridge according to claim 5, wherein the stem is biased in the projecting direction, and the detected portion, which corresponds to the press switch at a position closest to the printing head provided on the cartridge installation portion, among the n press switches presses the stem of the press switch regardless of the thickness of the installed tape cartridge when the tape cartridge is installed on the cartridge installation portion, and a platen opposing the printing head is further provided.

* * * * *